United States Patent [19]

Mahnke

[11] 4,101,124

[45] Jul. 18, 1978

[54] PULL TYPE EXERCISING APPARATUS

[76] Inventor: Parker E. Mahnke, 3055 Hollywell Pl., Glendale, Calif. 91206

[21] Appl. No.: 760,388

[22] Filed: Jan. 18, 1977

[51] Int. Cl.[2] ..... A63B 21/00

[52] U.S. Cl. ..... 272/134; 272/144; 272/145; 272/DIG. 4

[58] Field of Search ..... 272/127, 128, 138, 144, 272/145, 134, 117, DIG. 4

[56] References Cited

U.S. PATENT DOCUMENTS

| | | | |
|---|---|---|---|
| 1,402,106 | 1/1922 | Stark | 5/11 X |
| 2,781,526 | 2/1957 | Zimmerman | 5/11 X |
| 3,405,412 | 10/1968 | Mixon | 5/11 X |
| 3,589,720 | 6/1971 | Agamian | 272/134 |
| 3,892,404 | 7/1975 | Martucci | 272/134 |

FOREIGN PATENT DOCUMENTS

| | | | |
|---|---|---|---|
| 850,610 | 9/1939 | France | 272/134 |

*Primary Examiner*—William R. Browne
*Attorney, Agent, or Firm*—James E. Brunton

[57] ABSTRACT

An improved, lightweight, compact exercising apparatus wherein the exerciser positions himself on a carriage and exerts forces against his own weight by pulling or pushing the carriage along an inclined track assembly. At the upper end of the track assembly there is affixed a pair of guide sleeves which telescopically receive the legs of a U-shaped track elevator member. Movement of the guide sleeves up and down the legs of the elevator member varies angle of inclination of the track assembly. A unique locking mechanism is provided for locking the upper end of the track assembly at selected positions along the legs of the elevator member. The locking mechanism is a generally U-shaped member formed of a yieldably resilient material. Each side of the U-shaped member has a generally L-shaped free end portion. The free end portions are pivotally received in the apertures of the track elevating member and pivotally movable from a first interengaging position into a second locking position so that the end portions supportably engage the guide sleeves.

5 Claims, 6 Drawing Figures

PULL TYPE EXERCISING APPARATUS

BACKGROUND OF THE INVENTION

1. Field of the Invention

The present invention relates to exercising apparatus and more particularly to apparatus of the type wherein the exerciser exerts muscle effort against the weight of his own body.

2. Discussion of the Prior Art

Various designs of portable, slant board type exercising apparatus have been suggested. For the most part, however, these devices have been quite large and very difficult to transport and store. For this reason, many of the previously available slant board type devices are of necessity made foldable or collapsible in some manner. Additionally, most involve large numbers of manufactured parts and include rather complex adjustment and folding mechanisms making them quite expensive. Representative of these types of apparatus are those described in the patents to Martucci, U.S. Pat. No. 3,892,404, and to Thiede, U.S. Pat. No. 3,658,327.

The drawbacks of the prior art devices are largely overcome by the apparatus of the present invention which is small, lightweight, and carefully designed to minimize the number of component parts which make up the apparatus. As will become apparent from the description which follows, the apparatus of the present invention is of an extremely clean design and embodies a most unique and simple means for adjusting the slope of the inclined track assembly.

Because of the compactness of the apparatus, it need not be folded or collapsed for transport or storage. The track assembly, carriage, and track elevation standard are operably interconnected so that the unit can conveniently be moved and stored in one place. Further, due to its small size, the apparatus can be used almost anywhere as, for example, in a small bedroom or office.

Applicant is familiar with the following additional prior art which represents the closest art known to applicant and which serves to illustrate the novelty of the apparatus of the present invention: Courtney - U.S. Pat. No. 2,676,015; Bosch - U.S. Pat. No. 2,783,045; Miller - U.S. Pat. No. 2,924,456; Delinger - U.S. Pat. No. 3,545,748; Schotte - U.S. Pat. No. 850,610 (French).

SUMMARY OF THE INVENTION

It is an object of the present invention to provide an improved, low cost exercise apparatus for performing a large number of body exercises wherein the exerciser exerts muscle forces against the weight of his own body by pulling or pushing his body along an inclined track on a carriage mechanism.

It is another object of the invention to provide an apparatus of the aforementioned character which is lightweight, is constructed of a minimum number of inexpensively manufactured component parts, and requires no permanent installation.

It is a further object of the invention to provide an improved exercise apparatus in which progressive physical conditioning exercises can be accomplished by making extremely simple adjustments to the apparatus to increase or decrease the slope of the inclined track. In this regard, the slope of the track can be changed by merely releasing a uniquely designed locking assembly and telescopically sliding the upper end of the track assembly upward or downward along the leg portions of a U-shaped track support member. No tools are required to make the adjustments and at no time need the track assembly be physically separated from the track supported member.

It is still another object of the invention to provide an improved apparatus of the type described which is highly compact and easily storable and transportable with minimum effort.

It is a further object of the invention to provide an improved apparatus as heretofore described which can be inexpensively manufactured but, at the same time, is extremely rugged, durable, and safe to use.

In summary, these and other objects of the invention are realized by an improved exercising apparatus comprising a pair of spaced, substantially parallel track members each having a first and second end, the second ends being supportable on a supporting surface; a guide sleeve affixed to each of the track members proximate the first ends thereof, the guide sleeves extending substantially perpendicular to the track members; a generally U-shaped track elevating member having substantially parallel legs interconnected by an upper bight portion, the legs being telescopically receivable within the guide sleeves and having a plurality of longitudinally spaced apart apertures formed therein; track positioning means receivable within the apertures formed in the legs of the track elevating member and engageable by the guide sleeves for supporting the first ends of the track members at selected distances above the supporting surface; carriage means movably mounted on the track members for supporting a user of the apparatus, the carriage means being reciprocally movable along the length of the track members; and operating means along the tracks comprising a length of cord having a substantially center point affixable to the carriage means, a pair of handles affixed to a corresponding one end of the length of cord for grasping by the user, and a pair of eyelets each affixable to one of the track members proximate the first end thereof, the eyelets guiding the length of cord along intermediate portions thereof.

DESCRIPTION OF THE INVENTION

Figure 1:
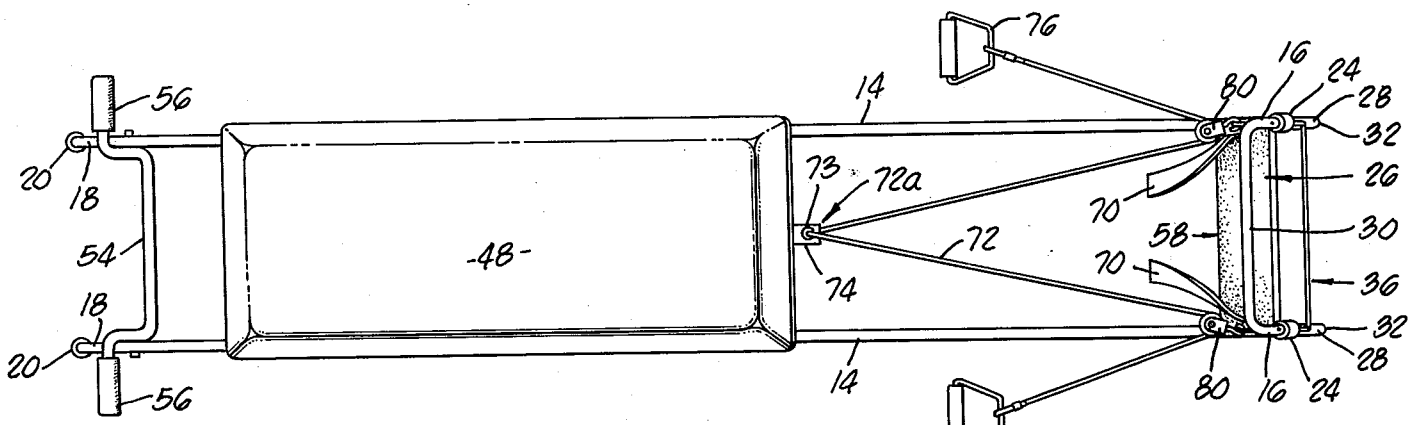
FIG. 1 is a top plan view of the improved exercising apparatus of the invention.
Figure 2:
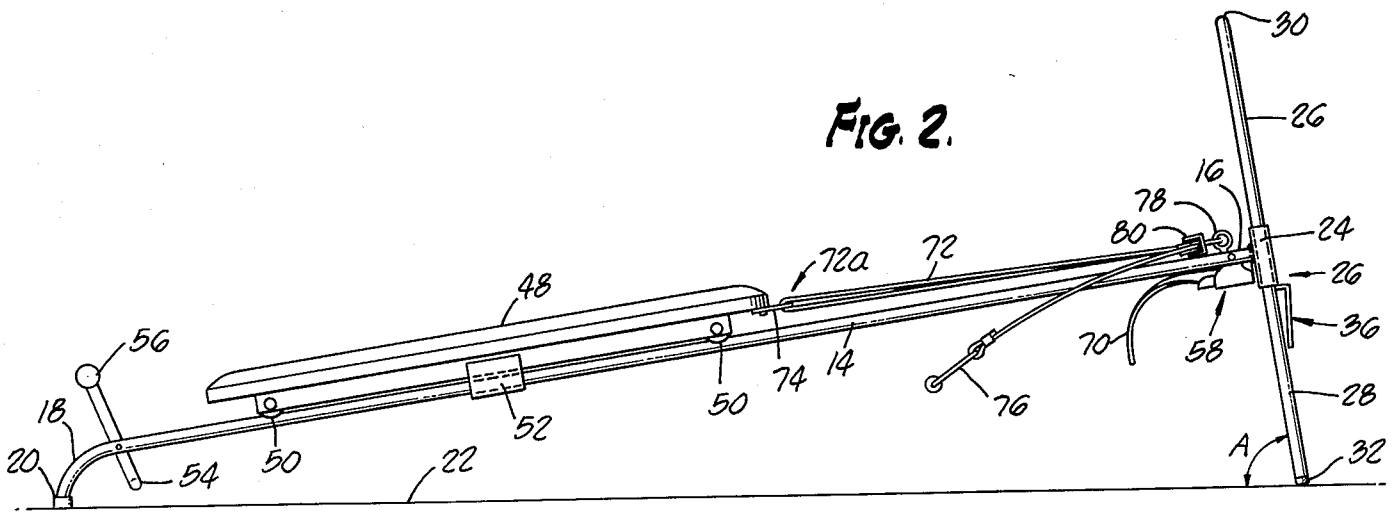
FIG. 2 is a side elevational view of the apparatus.
Figure 3:
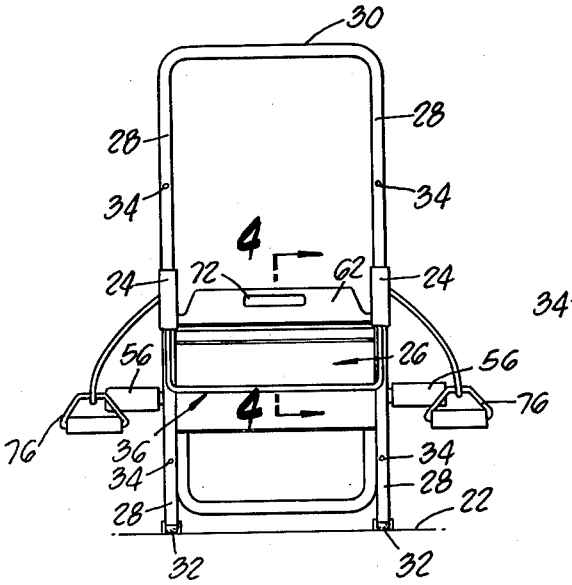
FIG. 3 is an end view of the right end of the apparatus as viewed in FIG. 2.

Referring to the drawings and particularly to FIGS. 1–3, the improved exercising apparatus of the invention comprises a pair of spaced, substantially parallel, generally cylindrically shaped track members 14, each having a first and second ends 16 and 18 respectively. As best seen in FIG. 2, second, or lower ends 18 are curved downwardly terminating in feet 20 adapted to be supported on a supporting surface 22. Feet 20 are preferably formed of a rubber or plastic material having supporting surface slip resistant characteristics. Track members 14 are preferably formed from a rigid metal tubing such as steel or aluminum.

Affixed to the second or upper end 16 of each track member is a generally cylindrically shaped guide sleeve 24. Guide sleeves 24 extend substantially perpendicular to the track members and are affixed thereto by welding or other suitable joining technique.

To support the second end of the track members in an elevated position relative to the supporting surface, there is provided generally U-shaped tubular track elevating member 26, having substantially parallel downwardly extending legs 28 interconnected by an upper bight portion 30. As shown in FIG. 2, legs 28 terminate in supporting surface engaging feet 32 which may be formed of rubber or plastic having slip resistant characteristics. Track elevating member is preferably formed in one piece from a metal tubing such as steel or aluminum.

Legs 28 of track elevating member 26 are telescopically receivable within guide sleeves 24, which sleeves are adapted to slide freely upwardly and downwardly along legs 28. Referring to FIG. 3, it can be seen that legs 28 are each provided with a plurality of longitudinally spaced apart apertures 34, the purpose of which will presently be described.

Figure 6:
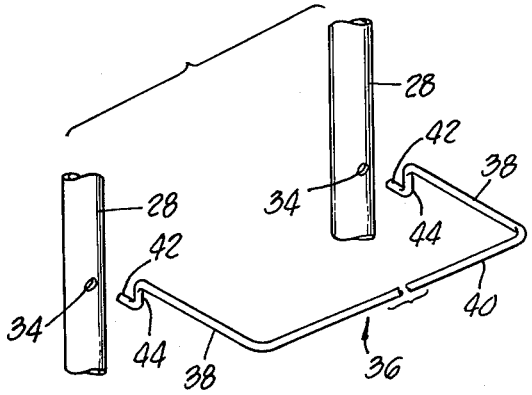
FIG. 6 is a fragmentary perspective view showing the support member having been further rotated to a position normal to the track elevating member and having been withdrawn from the apertures formed therein.
Figure 4:
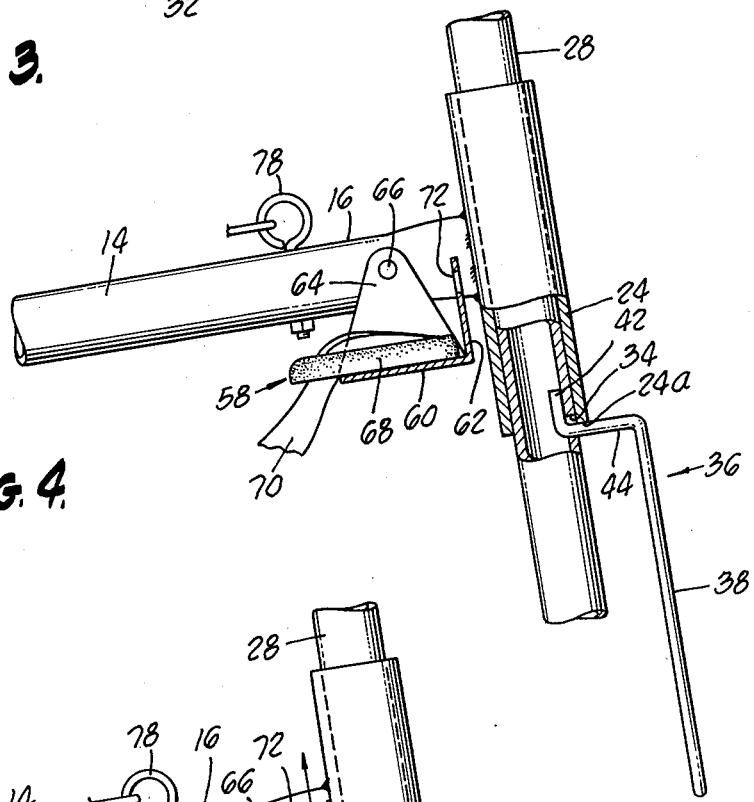
FIG. 4 is an enlarged view taken along lines 4—4 of FIG. 3 showing the track support means of the invention in a locked, track assembly supporting position.
Figure 5:
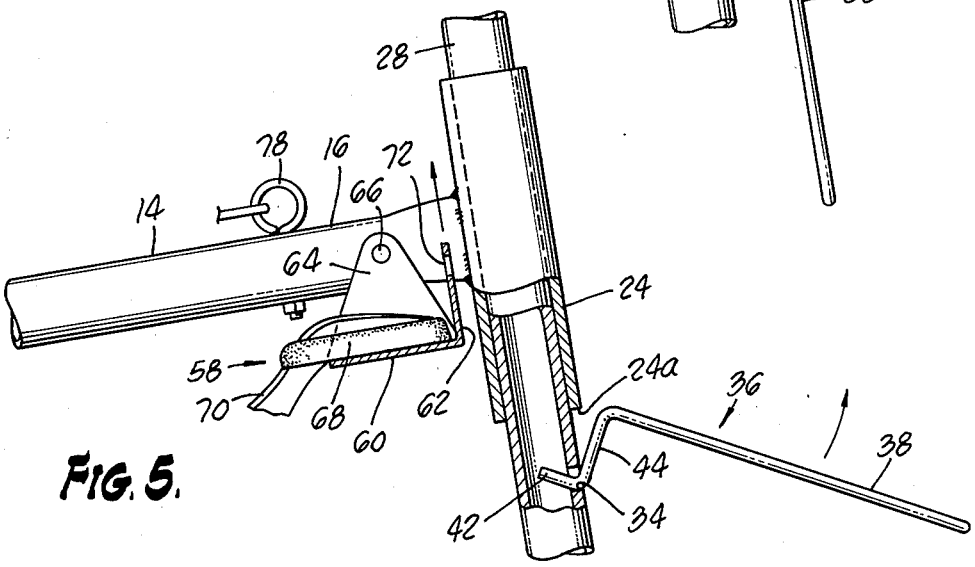
FIG. 5 is a view similar to FIG. 4, but showing the track assembly having been raised by a force exerted on the foot support member in the upward direction of the arrow, and showing the support means having been rotated relative to the track elevating member to an intermediate non-locking position.

To support the upper ends of the track members 14 at selected elevations above the supporting surface, there is provided support means shown in the drawings of this embodiment of the invention in the form of a generally U-shaped member 36. As best seen by referring to FIGS. 4 through 6, U-shaped member 36 has spaced substantially parallel sides 38 interconnected by a bight portion 40. The free end portions of member 36 are spaced apart a distance substantially equal to, but slightly wider than, the distance between legs 28 of track elevating member 26 and are formed in a generally L-shaped configuration. These L-shaped end portions comprise an outwardly extending first finger 42 which is spaced apart from side portions 28 and a second finger 44 which interconnects each first finger 42 with its respective side portion 38. As illustrated in FIG. 5, first finger 42 of the support means are receivable within the previously identified apertures 34 formed in the leg portions of the track elevating member. Member 36 is constructed of a yieldably resilient wire material so that its free end portions can be yieldably urged toward one another to permit insertion of fingers 42 into apertures 34. Apertures 34 are formed sufficiently large so that after the insertion of fingers 42, member 36 can be pivotally movable relative to said track elevating member to the locking position shown in FIG. 4 wherein fingers 42 have moved interiorally of tubular legs 28. In this locking position second fingers 44 extend substantially perpendicularly outward from legs 28 into a guide sleeve engaging orientation. As best seen in FIG. 4, with member 36 in a locking position, the lower extremity 24A of the guide sleeves 24 engage finger 44 of the support member so as to maintain the track members in an elevated position. To readjust the elevation of the tracks, member 36 is first pivotally moved relative to the track elevating member 26 in the manner illustrated in FIG. 5. Member 36 is then removed from the apertures 34 within which it is located and is illustrated in FIG. 6 preparatory to being inserted in the next upper or lower set of apertures formed along legs 28 of the track elevating member. With this construction the slope of the track assembly can quickly and easily be changed and positively locked into the desired position.

Referring again to FIGS. 1 and 2, the apparatus of the invention further includes carriage means 48 movably mounted on the track members 14. Rollers 50 (FIG. 2) are provided proximate each corner of the carriage means and are adapted to rollably engage the track members so that the carriage may roll freely along the entire length of the track members. Side brackets 52 are affixed to the carriage 48 proximate the midpoint thereof and function to hold the carriage in position on the track members.

Proximate the second or lower end of the track assembly is handlebar means 54 which are pivotally connected to and extend between track members 14. Handlebar means 54 includes at each side thereof handle portions 56 arranged so that when the trainee is positioned on the carriage means he can engage the handle portions with either his hands or with his feet depending upon his position on the carriage and the exercise being performed.

Mounted at the upper or first end of the track members 14 is a combination foot engaging and track elevating means 58 (FIG. 4). One purpose of means 58 is to hold the feet of the trainee when he is lying flat on the carriage means. Another purpose of means 58 is to enable the track assembly to be easily and effortlessly adjusted relative to the track elevating member 26 in a manner presently to be described.

As best seen in FIG. 4, means 58 comprises an angle member having a lower base portion 60 and upperwardly extending forward wall portion 62. Affixed to each end of the angle member and extending generally perpendicular to base portion 60 is a side portion 64 which is pivotally connected to a track member 14 by means of a pivot pin 66. With this arrangement the base portion 60 of the foot engaging member is disposed below the plane of the track members 14 and the member is freely swingable relative to the track assembly. A pad 68 is provided on the base portion 60 to cushion the heels of the trainee when his feet are strapped into position on the foot engaging means by ankle straps 70.

Referring to FIG. 3, it can be seen that forward wall portion 62 of the foot engaging means is provided with an opening 72 which is configured to receive the fingers of the trainee. As illustrated in FIG. 5, with this construction the foot engaging means can be conveniently grasped by the trainee and urged upwardly in the direction of the arrow to slidably move the guide sleeves 24 relative to the track elevating member 28. In this way the upper end of the track assembly can be positioned at the desired elevation above the supporting surface and held in position until the locking member 36 can be mated with the track elevating member and pivoted into a locking orientation in the manner previously described.

Turning again to FIGS. 1 and 2, operating means are provided for effecting reciprocal movement of the carriage 48 along the tracks 14. In this embodiment of the invention the operating means comprises a length of cord 72 having a substantially center point 72A affixable to carriage 48 by means of a grommeted opening 73 formed in a forwardly extending bracket 74 affixed to the carriage. A pair of handles 76 are affixed to the ends of cord 72 for grasping by the trainee when the trainee is positioned on the carriage. Proximate the upper end of each track member 14 is an eyelet 78 to which pulley 80 is pivotally connected. Pulleys 80 and eyelets 78, which comprise the cord guide means of this embodiment of the invention, serve to guide the length of cord 72 along intermediate portions thereof.

In using the improved exercising apparatus of the present invention, the trainee grasps means 58 and positions the track assembly at the desired elevation by effecting sliding movement of guide sleeves 24 upwardly or downwardly along legs 28 of track elevating member 26. The track assembly is held at the desired elevating position by means 58 while the free ends of member 36 are inserted into the appropriate set of apertures 34 formed in legs 28. Member 36 is then pivotally moved into the locking position as previously described and as illustrated in FIG. 4. In this position the guide sleeves are positively supported by finger 44 of the locking member so that the track assembly is firmly and safely held in the desired elevated position. In the track supporting position described, the track elevation means 26 is disposed at an optimum supporting angle relative to the support surface 22 and at all times lies in a plane defining an angle A (FIG. 2) of greater than 60° relative to the supporting surface.

Once the assembly has been positioned at the desired slope and the upper end thereof 16 locked against downward movement by support means 36, the trainee can safely position himself upon carriage 48. He can then propel himself against his own weight up or down the track assembly by pushing against handlebar means 54 with either his hands or feet. Alternating by sitting on the carriage, grasping handles 76 and pulling them in a direction toward the lower end of the track assembly he can cause the carriage 48 to move up the plane of the track assembly. Numerous types of exercises can be performed with the trainee facing either toward the handlebar means or toward the track elevating means in a sitting, kneeling, or lying position on his back or stomach.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An improved exercising apparatus comprising:

a. a pair of spaced, substantially parallel, generally cylindrically-shaped track members each having a first and second end, said second ends being supportable on a supporting surface;

b. a substantially cylindrically-shaped guide sleeve affixed to each of said track members proximate the first ends thereof, said guide sleeves extending substantially perpendicular to said track members;

c. a generally U-shaped tubular track elevating member having substantially parallel legs interconnected by an upper bight portion, said legs being telescopically receivable within said guide sleeves and having a plurality of longitudinally spaced apart apertures formed therein;

d. a pivotally movable, generally U-shaped member formed of a yieldably resilient material having spaced, substantially parallel sides interconnected by bight portion, said sides having generally L-shaped free end portions spaced apart a distance substantially equal to the distance between said legs of said track elevating member, said end portions being partially receivable within the apertures formed in said legs of said track elevating members and pivotally movable relative thereto from a first interengaging position into a second locking position said end portions being adapted to supportably engage said guide sleeves when said end portions are pivoted into said second locking position;

e. carriage means movably mounted on said track members for supporting a user of the apparatus, said carriage means being reciprocally movable along the length of said track members; and f. foot engaging means pivotally connected to said track members proximate the first ends thereof for engaging the feet of the user when the user is lying flat on said carriage means, said foot engaging means including handle means for grasping by the user to slidably move said guide sleeves relative to said track elevating member whereby said first ends of said track members can be positioned at selected distances above the supporting surface;

g. operating means for causing reciprocal movement of said carriage means along said tracks comprising:

1. a length of cord affixable to said carriage means;
2. a pair of handles affixed to a corresponding one end of the length of cord for grasping by the user; and
3. cord guide means mounted on said track members proximate the first end thereof, for guiding the length of cord along intermediate portions thereof.

2. An improved exercising apparatus as defined in claim 1 in which said L-shaped end portions each comprise an outwardly extending first finger spaced apart from said side portion and a second finger interconnecting said first finger and said side portion, said first finger being receivable within the apertures formed in said legs of said track elevating member and movable interiorly thereof by pivotal movement of said support means relative to said track elevating member to a position wherein said second fingers extend substantially perpendicularly outward from said legs into a guide sleeve engaging position.

3. An improved exercising apparatus as defined in claim 1 in which said track elevation means is disposed in a plane defining an angle with respect to the supporting surface of greater than 60°.

4. An improved exercising apparatus comprising:

a. a pair of spaced substantially parallel track members each having a first and second end, said second ends being supportable on a supporting surface;

b. a guide sleeve affixed to each of said track members proximate the first ends thereof, said guide sleeves extending substantially perpendicular to said track members;

c. a generally U-shaped track elevating member having substantially parallel legs interconnected by an upper bight portion, said legs being telescopically receivable within said guide sleeves and having a plurality of longitudinally spaced apart apertures formed therein;

d. U-shaped supported means receivable within the aperatures formed in said legs of said track elevating members and being pivotally movable from a first interengaging position into a second locking position wherein said means is engageable by said guide sleeves for supporting said first ends of said track members at selected distances above the supporting surface, said support means comprising spaced, substantially parallel sides interconnected by a bight portion, each of said sides having substantially L-shaped free end portions each comprising:

1. a first finger spaced apart from said side portion, said first finger being receivable in said apertures of said legs when said support means is in a first position; and
2. a second finger interconnecting said first finger and said side portion, said second finger being adapted to engage said guide sleeves when said support means is pivoted into said second locking position, whereby said first ends of said track members can be supported at a selected distance above the supporting surface;

e. carriage means movably mounted on said track members for supporting a user of the apparatus, said carriage means being reciprocally movable along the length of said track members; and f. operating means for effecting reciprocal movement of said carriage means along said tracks.

5. An improved exercising apparatus as defined in claim 4 in which said free end portions of said U-shaped support means are spaced apart a distance slightly wider than the distance between said legs of said U-shaped track elevating member and in which said U-shaped support means is constructed of a yieldably resilient wire material whereby said free end portions can be yieldably urged toward one another to permit insertion of said first fingers into the apertures formed in said legs.

* * * * *